US005581878A

United States Patent [19]

Langhenry et al.

[11] Patent Number: 5,581,878

[45] Date of Patent: Dec. 10, 1996

[54] METHOD OF MAKING WATER COOLED KICKLESS CABLE

[75] Inventors: Edwin F. Langhenry, Lakewood; Bruce Perin, Jr., Westlake; James J. Kasper, Sheffield Village, all of Ohio

[73] Assignee: Watteredge-Uniflex, Inc., Avon Lake, Ohio

[21] Appl. No.: 465,419

[22] Filed: Jun. 5, 1995

Related U.S. Application Data

[62] Division of Ser. No. 201,351, Feb. 24, 1994.

[51] Int. Cl.[6] ..... H01R 43/02

[52] U.S. Cl. ..... 29/860; 29/857; 174/15.7

[58] Field of Search ..... 174/15.7; 29/860, 29/857

[56] References Cited

U.S. PATENT DOCUMENTS

| | | | |
|---|---|---|---|
| 2,702,311 | 2/1955 | Botterill et al. | 174/15.7 X |
| 2,797,255 | 6/1957 | Wreford | 174/15.7 |
| 2,808,639 | 10/1957 | Wreford | 174/15.7 X |
| 2,906,807 | 9/1959 | Wreford | 174/15.7 |
| 3,363,047 | 1/1968 | Grove | 174/15.7 |
| 3,551,581 | 12/1970 | Goodman | 174/15 |
| 3,601,520 | 8/1971 | Carasso | 174/15.7 |
| 4,018,976 | 4/1977 | Grove | 174/19 |
| 4,199,653 | 4/1980 | Talley | 174/15.7 |
| 4,442,312 | 4/1984 | Oshkin et al. | 174/15.7 |
| 4,487,990 | 12/1984 | Lane et al. | 174/15 |
| 4,640,982 | 2/1987 | Kasper et al. | 29/860 X |
| 4,855,532 | 8/1989 | Tanabe | 174/15.7 |
| 5,317,804 | 6/1994 | Kasper | 29/860 |

*Primary Examiner*—Carl J. Arbes
*Attorney, Agent, or Firm*—Renner, Otto, Boisselle, Sklar

[57] ABSTRACT

An alternate polarity water cooled kickless cable utilizes semi-circular half terminal end members which have diameters abutting an insulator separator. The inner end of each terminal is provided with blind slots offset from each other along the abutting diameters. The slots are arranged for individual conductor strand fittings which are closely fitted and soldered in the appropriate slot. The slot arrangement is such that the good electrical contact is obtained on at least three sides and when the end members are secured together, the individual conductor strand terminations are captured within the slots so they cannot move transversely of the axis of the cable. A soft yieldable star or spur separator is employed between the terminations which has an enlarged center hole and a significant radius between each leg avoiding a sharp V-notch which would tend to pinch each conductor strand when the cable twists. At each end, the center hole is provided with a two-stage stiffener so that the overall cable will be most flexible in the middle and progressively less flexible near the terminations. The construction improves the efficiency and life of the cable. There is also disclosed a method of making the cable.

13 Claims, 2 Drawing Sheets

METHOD OF MAKING WATER COOLED KICKLESS CABLE

This is a division of copending application Ser. No. 08/201,351, filed Feb. 24, 1994.

DISCLOSURE

This invention relates generally as indicated to a water cooled kickless cable and method of making such cable, and more particularly to a cable which is more simply constructed, yet which provides improved efficiency and longer useful life.

BACKGROUND OF THE INVENTION

Alternate polarity kickless cables are well known in the art and are widely used to connect welding guns to transformers. Such cables have a number of stranded conductors or individual cables which alternate in polarity. A star separator isolates the adjacent cables which are connected to high current capacity end terminals which include semi-cylindrical halves insulated from each other. Since every other conductor has to be connected to opposite halves, the cable termination presents a complex connection which also happens to be the usual point of wear or failure limiting the service life of the cable. While the design of the cables is to minimize the kicking or twisting which occurs during each welding cycle, some, nonetheless, occurs. One application of such welding cables is in robotic welders. In such applications, the welding head may move into many different positions, again requiring the cable to flex or twist. It is therefore important that the overall cable be quite flexible in the middle, but not too flexible adjacent the terminations, where most stress concentrations occur.

One efficient form of cable termination is shown in prior U.S. Pat. No. 4,199,653 to Talley. Adjacent the terminations, the individual conductors are not twisted or threaded through each other to obtain the alternate polarity. An example of such twisting is seen in prior U.S. Pat. No. 4,487,990 to Lane, where the center cable in each group of three literally has to be twisted around the corresponding cable of the other group. This enlarges the overall cable or restricts internal passages.

In Talley, two sets of conductors are provided with each set of two including end fittings. There are also two individual conductors each mounted in a fitting, or six conductors altogether. The fittings and mounting surfaces on the two terminations are arranged suck that a single conductor fitting mounted on one half termination nests that single conductor slightly radially outwardly and between the two conductors of a two conductor fitting mounted on the opposite half termination. In this manner, the conductors do not have to twist or weave around each other and the cable is easier to construct and repair. The conductor fittings are readily mounted on appropriate platforms on the respective termination halves using fasteners. While the cable of the Talley patent has many advantages, one drawback is the use of such fasteners. If a fastener starts to loosen, it will shorten the life of the cable, even though it can readily be repaired. However, with the increasing use of such cables in exotic and expensive robotics machinery, any unscheduled downtime may be detrimental to major production and assembly lines.

For simplicity of construction, the star-shape spider core separator is preferred such as shown in the noted prior art patents. One drawback of such separators is that the V-notch between the radially projecting arms creates two pinch points on a conductor, particularly when the cable is twisted. What is normally a. 60° angle, for six conductors, can significantly reduce pinching and grabbing the individual strands of the conductor. This is particularly true if the separator is too hard or of wear resistant material and there is no significant radius at the notch.

It is also important that the separator provide significant flexibility between the terminations and less flexibility near the inflexible terminations. A gradation of increasing stiffness toward the terminations would be preferable to eliminate points of stress concentration.

It would therefore be desirable to provide a cable with the simplicity of conductor positions and construction, as disclosed in Talley, and yet have enhanced efficiency, reliability, and durability.

SUMMARY OF THE INVENTION

An alternate polarity water cooled kickless welding cable utilizes semi-circular half terminal end members which have diameters abutting an insulator separator. The inner end of each terminal is provided with blind slots offset from each other along the abutting diameters. The slots are arranged for individual conductor strand fittings which are closely fitted and soldered in the appropriate slot. The slot arrangement is such that good electrical contact is obtained on at least three sides and when the half terminal end members ire secured together, the individual conductor strand fittings are captured within the slots so they cannot move transversely of the axis of the cable. A soft yieldable star separator is employed between the terminations which has an enlarged center hole and a significant radius between each leg avoiding a sharp V-notch which would tend to pinch each conductor strand when the cable twists. At each end, the center hole is provided with a two stage stiffener so that the overall cable will be most flexible in the middle and progressively less flexible near the terminations. The construction improves the efficiency and life of the cable.

The invention also comprises a method of making the cable. Initially, conductor strands of the appropriate length are chosen. If the cable uses six conductors, two sets of two are provided at each end with what may be termed L-shape fittings while the remaining two are provided with single fittings. The projecting ends or tines of the fittings are press formed or swaged with precision.

Two semi-circular termination halves are provided with milled blind slots which open to the diameter and the inner end of the termination. The slots are sized, positioned and angled to receive the appropriate fitting ends or tines. The fittings are press fit and flood soldered in the respective slots and the entire connection is tinned.

The two semi-cylindrical halves at one termination are then connected with insulation between the facing diameters. This then captures the fittings in the slots. The insertion of the fittings within the slots and the assembly of the halves arranges the conductors in proper order with a single conductor connected to one half nesting between a pair connected to the other half. Maintaining the proper order and spacing, a spider insulator is provided with stiffeners at each end and which is inserted into the center of the conductors. The entire cable is then twisted so that the conductors form a gradual helix. After twisting, the opposite termination is connected and formed in the same way. The cable is inserted in a hose cover which is clamped to each termination so that water may be circulated through the hose during operation.

To the accomplishment of the foregoing and related ends the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION OF THE PREFERRED EMBODIMENTS

Figure 1:
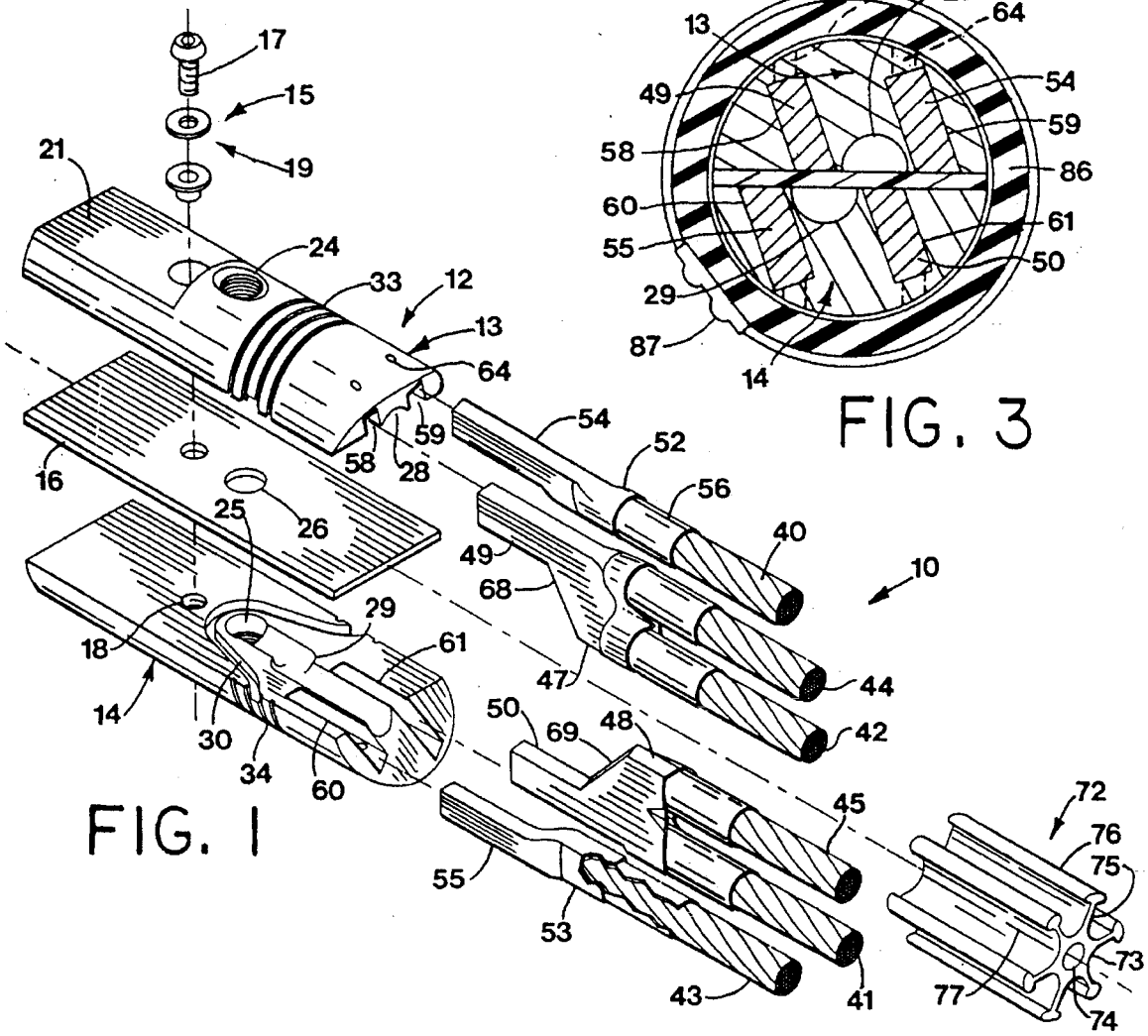
FIG. 1 is an exploded perspective view of one termination of a cable in accordance with the present invention.
Figure 2:
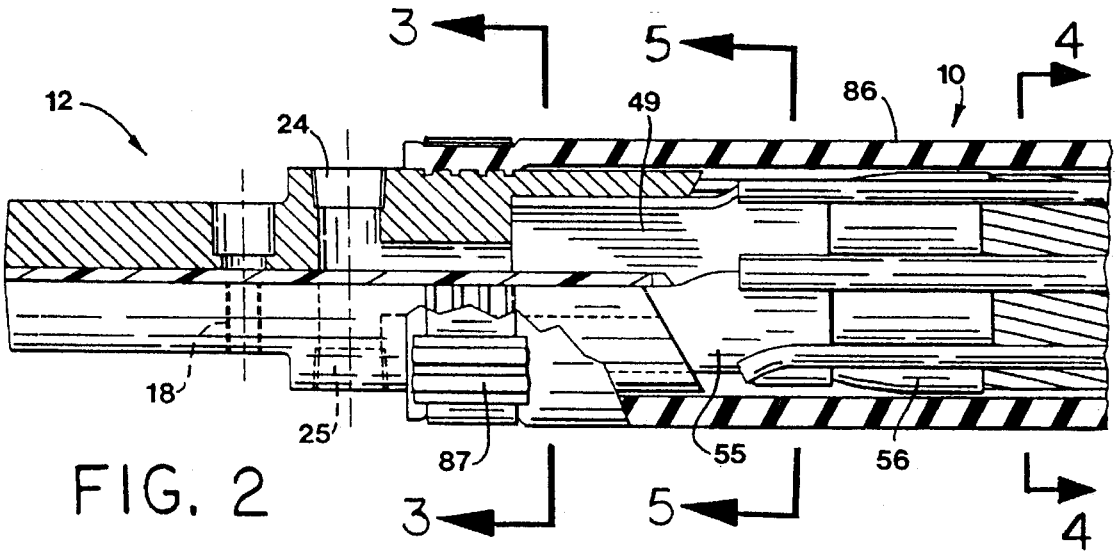
FIG. 2 is a fragmentary axial section of the termination after assembly.

Referring initially to FIGS. 1 and 2, there is illustrated a kickless water cooled alternate polarity welding cable in accordance with the present invention. The cable is shown generally at 10 and includes a termination 12 at each end, although only one is illustrated. Each termination comprises a pair of half-round semi-cylindrical copper blocks shown at 13 and 14 which are assembled together by insulated fastener assembly 15 with a layer of insulation 16 between the abutting diameters. The fastener 17 of the assembly 15 is threaded in tapped hole 18 in the half-round termination end member 14 and insulated from the opposite end member by the washer and flanged sleeve illustrated at 19.

Figure 7:
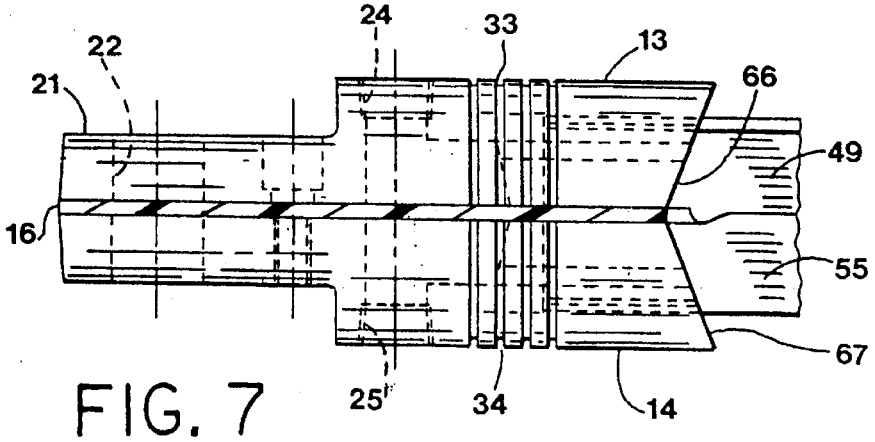
FIG. 7 is a fragmentary side elevation of the termination showing the inclined inner faces of each termination half.

The outer tips of the half-round end members may be provided with flats as illustrated at 21 as well as suitable fastening holes not shown in FIGS. 1 and 2, but illustrated at 22 in FIG. 7. Such flats and holes may be utilized to secure the cable to the welding head or transformer, for example. The half-round ends include threaded ports 24 and 25, respectively which communicate with each other through hole 26 in the insulator 16 in the respective abutting diameters of the end members. The ports are in communication with coolant passages 28 and 29 in half-round end members which open to the abutting diameters. The abutting diameters are formed with flaring U-shape seal groove 30 which extends from outboard the fitting holes to inboard the circumferential grooves 33 and 34 in the cylindrical exteriors of the half-round members, respectively.

Figure 4:
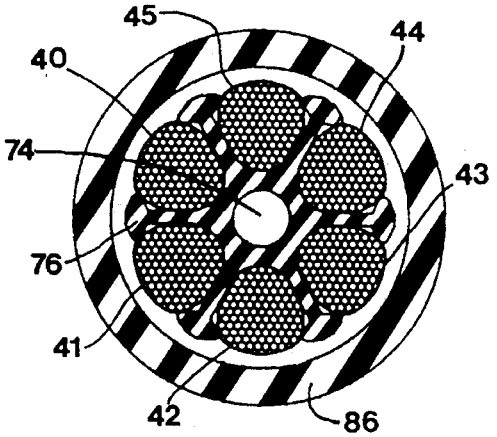
FIG. 4 is a similar section from the line 4—4 of FIG. 3.
Figure 5:
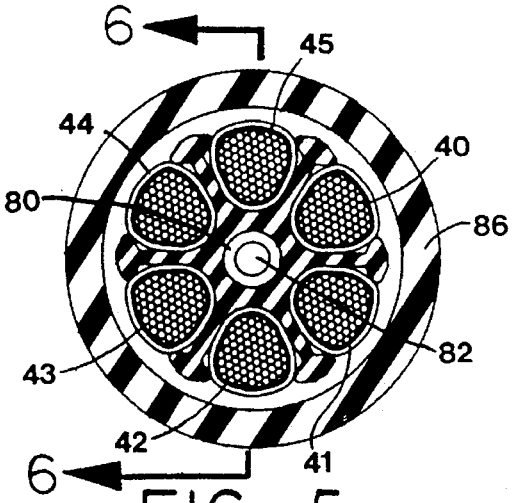
FIG. 5 is a similar section from the line 5—5 of FIG. 2.

In the illustrated cable, the termination 12 is connected to the opposite terminal by six stranded individual conductors shown at 40, 41, 42, 43, 44 and 45. Although the perspective view of FIG. 1 seems to have the numbers assigned to each individual conductor out of order, it is noted in comparing FIGS. 4 or 5 that the cables are numbered in counterclockwise or clockwise order as shown in such respective Figures. Of the six, two pairs of two conductors are formed, such pairs being shown at 42 and 44, and also 41 and 45. The ends of the conductors 42 and 44 are provided with an L-shape fitting seen at 47 while the pair 41 and 45 is provided with a similar L-shape fitting seen at 48. The fitting is pressed or swaged on the conductor ends and each includes a single offset projecting the as seen at 49 and 50, respectively. End fittings are provided for the single conductors 40 and 43 as seen at 52 and 53, respectively, which include respective single point tines 54 and 55. Each conductor where it enters the fitting mouth or inner edge of the fitting is provided with a protective plastic sleeve as seen at 56 to reduce stress concentrations at such edges.

The tines for the respective fittings are designed closely to fit within blind milled slob in each half-round end member, such slots being open to the diameter of each member and also to the inner end face of each member. The slob for the tines 49 and 54 in the half round member 13 are seen at 58 and 59, while the slots in the half round member 14 are seen at 60 and 61. Such slob receive the tines 49, 54, 55 and 50, respectively. The position of the various tines and slots, when assembled, is seen more clearly in FIG. 3.

When formed, the tines of the conductor fittings are shaped to fit the slots as closely as possible so that they have to be forced into the slots such as by tapping with a mallet. Both the conductors and the fittings may be one eighth (⅛) hard. This facilitates both the precision forming of the tines as well as increases the useful life of the cable. The fittings are preferably flood soldered in the slots, although brazing may also be employed. In order to facilitate the flood soldering, each slot may be provided with a small port extending to the cylindrical exterior of the half-round end member as seen at 64. Such ports may be utilized either to inject solder into the slots or to permit excess solder to exit the slot as the tines are tapped or forced into place. After the soldering operation the entire tine-half round end member connection is preferably tinned.

Figure 3:
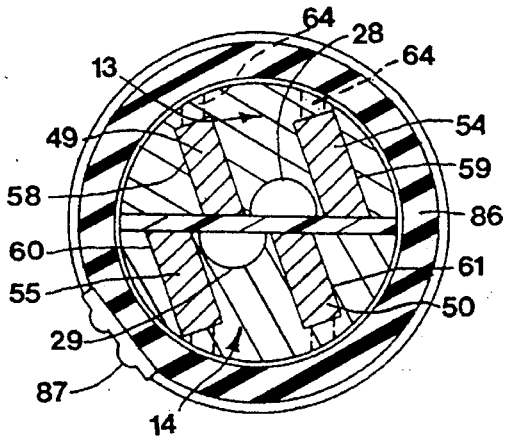
FIG. 3 is a transaxial section taken substantially on the line 3—3 of FIG. 2.

As seen more clearly in FIGS. 3 and 7, the slots 58–61 are rectangular in transverse section and each includes two parallel sides and a bottom, all of which are in contact with the respective fine. Each slot 58 is open to the abutting diameters and also to the axial inner end face of each half-round member. Such inner end faces seen at 66 and 67 in FIG. 7 are inclined to form an inwardly opening V-notch when the parts are assembled. Each L-shape fitting has the short leg of the L similarly inclined as seen at 68 and 69 in FIG. 1 to extend offset or spaced, yet parallel, to the inner end face of the opposite half-round end member.

As seen more clearly in FIG. 3, the parallel sides of each slot are inclined with respect to the abutting diameters at an acute angle of about 70°. All slob are similarly inclined so that the parallel longer sides of each slot are all parallel to each other. The slots 58 and 59 in the half-round end member 13 are spaced from each other along the diameter as are the slots 60 and 61 and such slob are also offset or spaced from the opposite slot. Thus, the slot 58 is offset from the slot 60 as is the slot 59 from the slot 61, all along the diameter. The arrangement of the slots is such that the single conductor fitting will nest the conductor thereof properly between the dual conductors fitted in the opposite end member to obtain the alternate polarity positions throughout the length of the cable.

After the conductors are secured to the respective half-round termination end members and the end members are secured together, the conductors are laid out on a table and positioned around a star or spider separator shown generally at 72. The separator has a fairly large central core 73 with a central hole 74 extending completely therethrough, and six equally spaced radial arms 75, each terminating in a relatively large bead 76. The notch between each adjacent arm is formed with a significant internal radius seen at 77 into which the respective conductor nests. The radius and adjoining arms embrace the conductor for well more than half of the circumference of the conductor. The radius at the interior of each arm enlarges the center or core 73 which in turn enables the through hole 74 to be formed. The spider separator is preferably extruded of a relatively soft silicon rubber material which embraces the interior surface of each conductor in a manner to avoid pinch points which would occur in conventionally used spiders or separators when the cable undergoes twisting.

Figure 6:
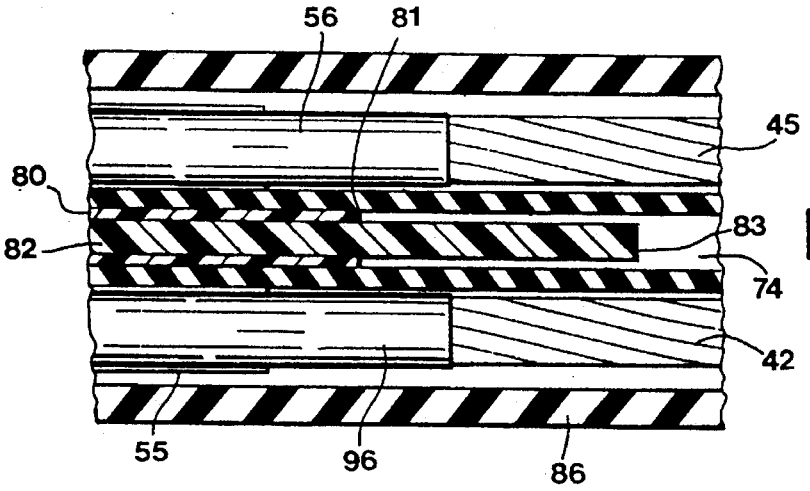
FIG. 6 is another fragmentary axial section as taken from the line 6—6 of FIG. 5 illustrating stiffeners inserted in the end of the spider separator.

Before the separator is inserted into the center of the annular array of conductors, stiffeners are inserted in each end of the hole 74. As seen in FIG. 6, these stiffeners may comprise a plastic tube 80 which would extend from the end of the separator inwardly. The tube is a plastic material such as nylon, polyester, or a PVC which is somewhat stiffer than the soft silicon rubber. The tube extends inwardly from the end of the separator to the point indicated at 81 which is inwardly beyond the conductor fitting 55. The somewhat harder plastic tube is telescoped into the hole with a force fit so that it won't become dislodged. A cap or flange may be provided on the tube overlying the end of the separator so that the tube won't move further axially into the hole. Inserted in the tube 80 is a somewhat longer rod 82 which may be of the same stiffer plastic material. Such rod projects beyond the tube to the point 83. Again, the rod may be provided with a cap or flange to keep it in proper position. It can be seen then that the tube and rod stiffeners of unequal length create zones of increasing stiffness as one moves toward the terminations. The length of the cantilevered and projecting rod within the hole from the point 83 to the point 81 constitutes the intermediate zone of stiffness while the most stiffness is obtained by the rod and tube from the point 81 to the termination. This gradation of stiffness of the cable adjacent the terminations not only increases the service life thereof by reducing stress concentrations, but also insures that the highest degree of flexibility will be in the middle of the cable. The soft silicon rubber with the enlarged core and enlarged center hole contributes to the flexibility of the cable.

With the stiffeners in place the conductors are threaded onto the separator and the separator and conductors are then twisted or caused to extend in a spiral fashion. After the twisting of the conductors and separator, the half-round end members of the opposite termination are secured to the opposite ends of the conductors in the same fashion and the opposite end members are secured together with insulation therebetween to form a termination which may be identical to that illustrated.

After the cable is thus constructed, it is telescoped into a hose cover 86 which is secured to both terminations by the hose clamps 87 which compress the hose around the external grooves 33 and 34. Water may then be circulated through the cable using the fittings 24 or 25 at each end. Water normally does not circulate through the center hole 74 in the spider separator.

It can now be seen that there is provided a welding cable which includes blind axially extending slots into which the conductor terminations are inserted and in which such conductor terminations are captured when the half-round end members are assembled together. Good electrical contact between the fitting and the slot is obtained on at least three sides of the slot and the flood soldering provides a good low resistance connection. More importantly, the useful life and serviceability required for robotic operations is achieved. Contributing to this extended life is a star separator which avoids pinching the conductor strands when the cable is twisted, and which provides a higher degree of flexibility in the center of the cable and increasing stiffness toward the terminations avoiding stress concentrations.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

We claim:

1. A method of making a welding cable comprising the steps of milling internal slots in the diameters of half-round terminations, fitting electric conductor ends in said slots, and joining said half round terminations with insulation therebetween to capture said conductor ends when said half round terminations are joined.

2. A method as set forth in claim 1 including the step of soldering the conductors in said slots.

3. A method as set forth in claim 1 including the step of milling two slots in each half round termination, and fitting a dual conductor in one and a single conductor in the other.

4. A method as set forth in claim 1 including the step of tapping the conductor ends into the respective slots.

5. A method as set forth in claim 3 including the step of milling each slot to be rectangular with parallel sides.

6. A method as set forth in claim 3 including the step of inclining each slot with respect to the respective diameters.

7. A method as set forth in claim 5 including the step of positioning said slots along the respective diameters such that a single conductor end fitted in a slot of one half-round round termination nests between the dual conductors fitted in the opposite half-round termination when said half-round terminations are joined.

8. A method as set forth in claim 7 including the step of providing said dual and single conductor end fittings closely to match the respective slots.

9. A method as set forth in claim 8 including the step of soldering each fitting in the respective slot and then tinning the connection.

10. A method as set forth in claim 8 including the step of tapping the dual and single conductor end fittings into the respective slots.

11. A method as set forth in claim 7 including the step of providing a star separator between each conductor between terminations, and causing the separator to embrace uniformly the inner surface of each conductor when the cable is twisted.

12. A method as set forth in claim 11 including the step of reducing the flexibility of said cable adjacent the terminations.

13. A method as set forth in claim 12 including the step of reducing the flexibility of said separator adjacent the terminations.

* * * * *